US005539687A

United States Patent [19]

Torisawa et al.

[11] Patent Number: 5,539,687

[45] Date of Patent: Jul. 23, 1996

[54] CORRELATOR AND COMMUNICATION SYSTEM USING IT

[75] Inventors: Akira Torisawa, Machida; Koichi Egara, Tokyo; Tadashi Eguchi, Kawasaki, all of Japan

[73] Assignee: Canon Kabushiki Kaisha, Tokyo, Japan

[21] Appl. No.: 167,074

[22] Filed: Dec. 15, 1993

[30] Foreign Application Priority Data

Dec. 17, 1992 [JP] Japan ..... 4-354696

[51] Int. Cl.[6] ..... G06G 7/12

[52] U.S. Cl. ..... 364/821; 310/313 D

[58] Field of Search ..... 364/821, 819, 364/728.03, 728.05, 728.06; 310/313 R, 313 B, 313 D; 333/153, 154, 195

[56] References Cited

U.S. PATENT DOCUMENTS

| | | | |
|---|---|---|---|
| 3,675,163 | 7/1972 | Hartmann et al. | 310/313 R |
| 3,770,949 | 11/1973 | Whitehouse et al. | 364/821 |
| 4,207,546 | 6/1980 | Grudkowski | 364/821 |
| 4,224,683 | 9/1980 | Adkins | 364/821 |
| 5,043,620 | 8/1991 | Mitsutsuka | 364/821 |
| 5,164,628 | 11/1992 | Egara et al. | 310/313 D |
| 5,200,663 | 4/1993 | Mochizuki et al. | 310/313 D |
| 5,220,230 | 6/1993 | Niitsuma | 364/819 X |

OTHER PUBLICATIONS

"Applications of Surface Acoustic Wave" by Shibayama, Television, 30, 457 (1976) pp. 457–463.

*Primary Examiner*—Tan V. Mai

*Attorney, Agent, or Firm*—Fitzpatrick, Cella, Harper & Scinto

[57] ABSTRACT

A correlator includes a reference signal generating device for generating a reference signal with period T, n-convolvers each having an action time of T/n where n is an integer of at least 2, into each of which an information signal and a reference signal are input and each of which outputs a convolution signal of the information signal and the reference signal, a delay device for delaying an information signal input into a k-th convolver among the n convolvers for a time of (k−1)T/n where k=1, 2, . . . , n and for delaying a reference signal input into the k-th convolver for a time of (n-k)T/n, and an adder for adding convolution signals respectively output from the n convolvers. A receiver includes such a correlator for outputting a correlation signal of a received information signal and a reference signal, and a decoding circuit for decoding data from the correlation signal output from the correlator. A communication system includes a transmitter for transmitting an information signal, and a receiver for receiving the information signal transmitted from the transmitter and having the correlator.

28 Claims, 9 Drawing Sheets

CORRELATOR AND COMMUNICATION SYSTEM USING IT

BACKGROUND OF THE INVENTION

1. Field of the Invention

The present invention relates to a correlator using a convolver to output a convolution signal of information signal and reference signal, and a communication system using it.

2. Related Background Art

A correlator uses a surface acoustic wave convolver for obtaining a convolution signal of two surface acoustic wave signals, which is recently rising in importance and very actively being investigated as a key device in spread spectrum communication.

FIG. 1 is a schematic plan view to show an example of conventional correlator of this type. In FIG. 1, reference numeral 31 designates a piezo-electric substrate of Y-cut (Z-propagating) lithium niobate or the like, 32, 33 input inter-digital transducers (IDT) which are comb electrodes formed on the surface of piezo-electric substrate 31, and 34 an output electrode formed on the surface of piezo-electric substrate 31. These electrodes are made of a conductive material such as aluminum and usually formed utilizing the photolithography technology. A signal input circuit (IN) 36 is connected to the input IDT 32, and a generator (PN) 35 for generating a pseudo noise (PN) code signal as reference signal is connected to the input IDT 33.

When an electric signal with carrier angular frequency ω is input from the signal input circuit 36 into the input IDT 32 in the correlator as so arranged, the piezo-electric effect of substrate causes a surface acoustic wave to propagate therein. Similarly, when an electric signal with carrier angular frequency ω is input from the PN signal generator 35 into the input 10 IDT 33, the piezo-electric effect of substrate causes a surface acoustic wave to propagate therein. These two surface acoustic waves propagate in mutually opposite directions on the piezo-electric substrate 31, from which a convolution signal (with carrier angular frequency 2 ω), which is a correlation output of the two input signals, can be obtained through the output electrode 34 by the physical nonlinear effect of piezo-electric substrate.

Letting F(t-x/v)exp{j(ωt-kx)}and G(t+x/v)exp{j(ωt+kx)} stand for the two surface acoustic waves, the nonlinear interaction produces a surface acoustic wave of their product F(t-x/v)·G(t+x/v)exp(2jωt) on the piezo-electric substrate 31. By providing a uniform output electrode, this signal can be integrated within a region of length of the electrode. Letting L be a length of interaction region, an output signal can be expressed as follows.

$$S(t) = K\exp(2j\omega t)\int_{-L/2}^{L/2} F(t-x/v)\cdot G(t+x/v)dx \tag{1}$$

Here, the integration range can be deemed as substantially between −∞ and +∞ if the interaction region length L is sufficiently larger than the signal length. Putting τ=t-x/v into above Equation (1), the following equation is obtained.

$$S(t) = -vK\exp(2j\omega t)\int_{-I}^{I} F(\tau)\cdot G(2t-\tau)d\tau \tag{2}$$

In the above equation, I for integration range represents ∞. The resultant signal is a convolution of the two surface acoustic waves. This mechanism of convolution is described in detail for example in "SHIBAYAMA, "Applications of surface acoustic wave," TELEVISION, 30, 457 (1976)."

The operation of the correlator as described is next described referring to FIGS. 2A and 2B. Let ABCDEFGH represent a pseudo noise signal 39 input from the PN signal (reference signal) generator 35 into the input IDT 33. Here, A, B, . . . each mean a code string having an arbitrary length and a code set, for example 001, 010, 011, . . . . The signal input circuit 36 also supplies a same input signal 38 of ABCDEFGH to the input IDT 32. The signal 38, 39 of ABCDEFGH has a period of T. These signals are converted by the input IDTs 32, 33 into respective surface acoustic waves, which propagate on the surface of piezo-electric substrate 31. FIGS. 2A and 2B illustratively show states of propagation. As seen from the drawings, the pseudo noise signal 39 is input into the input IDT 33 such that the order of code strings is reversed as HGFEDCBA. At the same time, the contents of each code string A, B, C, . . . are also reversed in order. The surface acoustic wave from the input signal 38 propagates from left to right while that from the pseudo noise signal 39 from right to left. Since in FIG. 2A the signals 38, 39 are not coincident with each other at the position of output electrode 34, no correlation signal appears from the output electrode 34. In FIG. 2B, the signals 38, 39 are coincident with each other at the position of output electrode 34, so that a correlation signal appears from the output electrode 34.

In this arrangement, the period T of pseudo noise signal 39 is equal to that of one bit of a signal to be transmitted. If a signal transmission speed is 64 Kbits/sec, the period of one bit is 15.6 psec. Since the speed of surface acoustic wave propagating on the surface of lithium niobate is about 3400 m/sec, a product of those is about 53 mm, which is a distance which the surface acoustic wave travels in the period of one bit, that is, in a code string unit of pseudo noise signal 39. This distance is an action length, which is equal to the length of the output electrode 34. Also, the width of output electrode 34 is set about 1.5 to 4 times greater than the wavelength of surface acoustic wave. In case the frequency of surface acoustic wave is 200 MHz, then the wavelength of surface acoustic wave is about 17 μm, and therefore the width of output electrode 34 is in the range of about 25 μm to 70 μm.

As described above, the conventional correlators were very long in length of output electrode as compared with the width of output electrode in convolver and therefore the size of convolver was determined by the length of output electrode, which raised a problem of increase in size of correlator.

SUMMARY OF THE INVENTION

It is an object of the present invention to solve the above problem in conventional technology and to provide a compact correlator and a communication system using it.

In an aspect of the present invention, achieving the above object, a correlator comprises:

reference signal generating means for generating a reference signal with period T;

n convolvers each having an action time of T/n where n is an integer of at least 2, into each of which an information signal and a reference signal are input and each of which outputs a convolution signal of the information signal and the reference signal;

delay means for delaying an information signal input into a k-th convolver among the n convolvers for a time of (k−1)T/n where k=1, 2, . . . , n and for delaying a reference signal input into the k-th convolver for a time of (n-k)T/n; and adding means for adding convolution signals respectively output from the n convolvers.

In another aspect of the present invention, achieving the above object, a correlator comprises:

a reference signal generating circuit for generating a reference signal with a predetermined period;

first and second convolvers each having an action time equal to a half of period of the reference signal, into each of which an information signal and a reference signal are input and each of which outputs a convolution signal of the information signal and the reference signal;

a delay means for delaying an information signal input into the second convolver for a time equal to a half of the period of reference signal and for delaying a reference signal input into the first convolver for a time equal to a half of the period of reference signal; and adding means for adding convolution signals respectively output from the first and second convolvers.

Also, a receiver used in communication system of the present invention comprises the above correlator and a decoding circuit for decoding data from a correlation signal output from the correlator.

Further, a communication system of the present invention comprises a transmitter for transmitting an information signal and a receiver having the above correlator and receiving the information signal transmitted from the transmitter.

DESCRIPTION OF THE PREFERRED EMBODIMENTS

Specific embodiments of the present invention will be described with reference to the accompanying drawings.

First Embodiment

Figure 1:
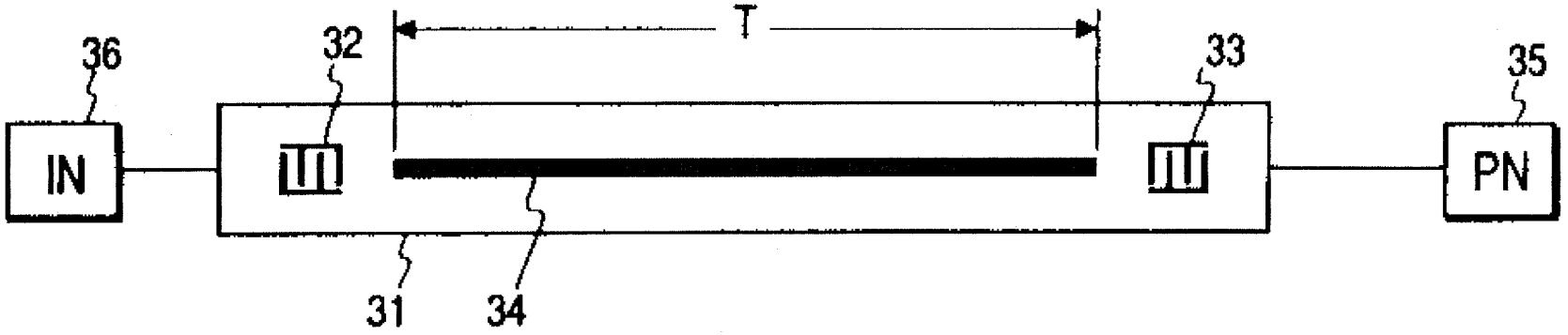
FIG. 1 PRIOR ART
FIG. 1 is a schematic plan view to show an example of conventional correlator.
Figure 2A:
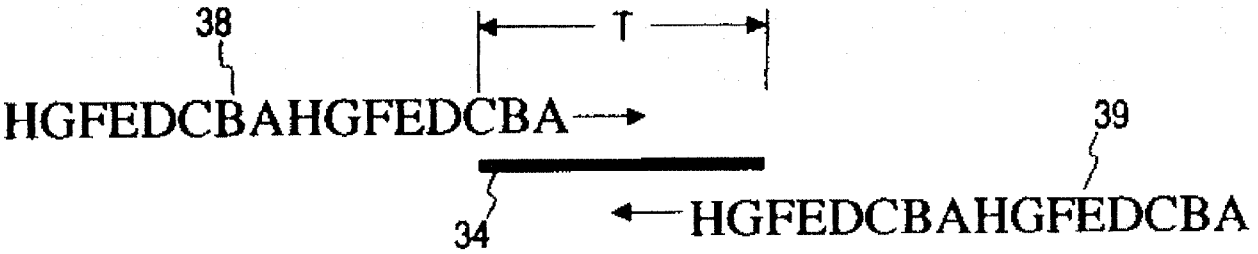
FIG. 2A PRIOR ART
FIG. 2A and FIG. 2B are illustrations to describe the operation of the correlator shown in FIG. 1.
Figure 2B:
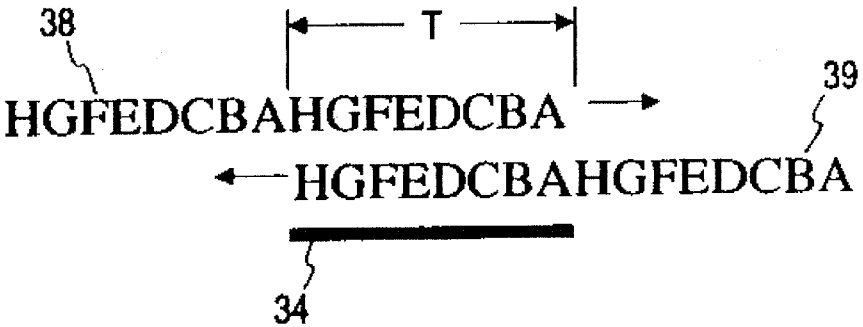
FIG. 2B PRIOR ART
Figure 3:
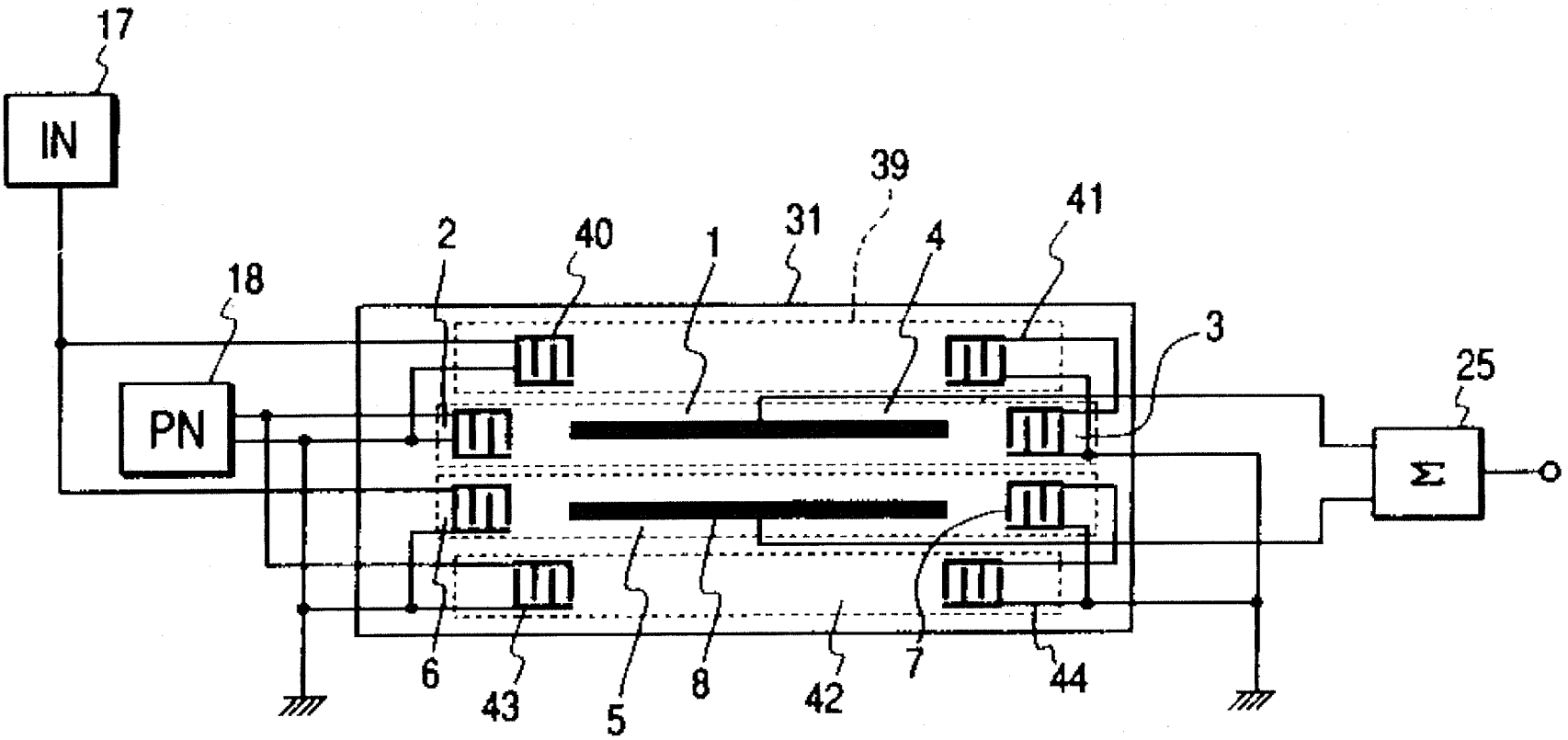
FIG. 3 is a schematic plan view to show a first embodiment of correlator according to the present invention.

FIG. 3 is a schematic plan view to show the first embodiment of correlator according to the present invention. In FIG. 3, reference numeral 31 denotes a piezo-electric substrate for example of lithium niobate, and there are two convolvers 1, 5 and two delay circuit elements 39, 42 formed on the surface of piezo-electric substrate 31. The convolver 1 has input IDTs 2, 3 and a convolution output electrode 4, while the convolver 5 input IDTs 6, 7 and a convolution output electrode 8. These two convolvers have the same shape and function. The delay circuit element 39 has IDTs 40, 41 constituting a surface acoustic wave filter, while the delay circuit element 42 has IDTs 43, 44 constituting a surface acoustic wave filter. These two delay elements have the same shape and function.

Numeral 17 designates a signal input circuit and 18 a pseudo noise signal generator for generating a pseudo noise signal as reference signal. Numeral 25 represents an adder for adding convolution outputs from the output electrodes 4, 8 of two convolvers 1, 5 to obtain a correlation signal. The circuits 17, 18, 25 are connected to the convolvers 1, 5 and the delay circuit elements 39, 42, as shown in FIG. 3.

In the convolver 1, surface acoustic waves Generated in the input IDTs 2, 3 propagate in mutually opposite directions along the longitudinal length of output electrode 4. A delay time by the delay circuit element 39 is equal to a time in which the surface acoustic waves generated from the input IDTs 2, 3 travel the length of output electrode 4. The length of output electrode 4 is equal to a distance which the surface acoustic waves travel in a time (T/2) which is a half of period T of code strings in pseudo noise signal as reference signal. The two IDTs 40, 41 are set at the same distance in the delay circuit element 39.

In the convolver 5, surface acoustic waves Generated in the input IDTs 6, 7 propagate in mutually opposite directions along the longitudinal length of output electrode 8. A delay time by the delay circuit element 42 is equal to a time in which the surface acoustic waves generated from the input IDTs 6, 7 travel the length of output electrode 8. The length of output electrode 8 is equal to a distance which the surface acoustic waves travel in a time (T/2) which is a half of period T of code strings in pseudo noise signal as reference signal. The two IDTs 43, 44 are set at the same distance in the delay circuit element 42.

FIG. 4A to FIG. 4D are illustrations to describe the operation of the present embodiment. Suppose the PN signal (reference signal) generator 18 generates a signal of ABCDEFGH and the signal input circuit 17 the same signal. The pseudo noise signal is input into IDTs in the reversed order of code strings as HGFEDCBA which is reverse to the input signal from the signal input circuit 17. In this occasion, the contents of each code string A, B, C, . . . are also reversed in order. FIGS. 4A to 4D are illustrated such that the surface acoustic wave based on the input signal from the signal input circuit 17 propagates from left to right while the acoustic surface wave based on the pseudo noise signal from right to left. The propagation directions are not always coincident with those of the actual surface acoustic waves in FIG. 3.

Figures 4A, 4B, 4C, 4D:
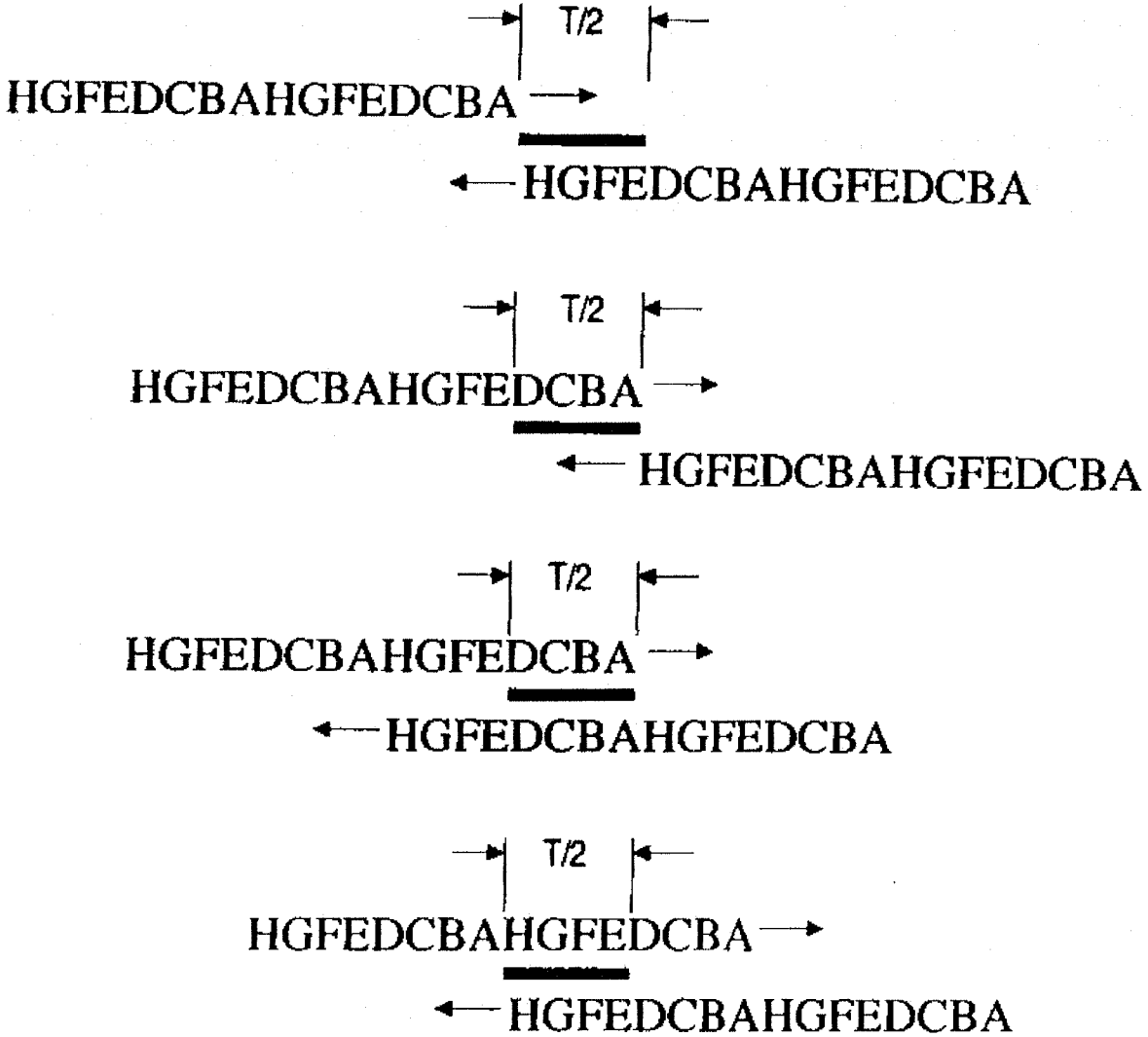
FIG. 4A to FIG. 4D are illustrations to describe the operation of the correlator shown in FIG. 3.

FIG. 4A shows a state of convolver 1 after the time of T/2 has elapsed. At this moment, the input signal is not transferred to the input IDT 3 yet because of the delay operation of time T/2 by the delay circuit 39, so as to produce no surface acoustic wave. On the other hand, the pseudo noise signal is supplied without passing through the delay circuit, so that the input IDT 2 already generates the surface acoustic wave of HGFE which reaches the output electrode 4. Since there is no coincidence between two signals, no correlation signal appears from the output electrode 4. FIG. 4B shows a similar state of convolver 5 after the time of T/2 has elapsed. Since the input signal is supplied without passing through the delay circuit, the input IDT 6 already generates a surface acoustic wave of ABCD which reaches the output electrode 8. At this moment, the pseudo noise signal is not transmitted to the input IDT 7 because of the delay operation of time T/2 by the delay circuit 42, so as to cause no surface acoustic wave. Here, since there is no coincidence between two signals, no correlation signal appears from the output electrode 8. Therefore, no correlation signal is output from the adder 25.

FIG. 4C shows a state of convolver 1 after the time of additional T/2 has further elapsed (which means that the time of T has elapsed from the beginning). The delay operation of time T/2 by the delay circuit 39 causes ABCD in input signal to be transferred to the input IDT 3 at this time, whereby a surface acoustic wave therefor is generated and reaches the output electrode 4. On the other hand, since the pseudo noise signal is supplied without passing through the delay circuit, the input IDT 2 already generated the surface acoustic wave up to DCBA, which reaches the output electrode 4. Now correspondence is made between the two signals, so that a correlation signal is output from the output electrode 4. FIG. 4D shows a similar state of convolver 5 after the time of additional T/2 has further passed (which means that the time of T has elapsed from the beginning). Since the input signal is supplied without passing through the delay circuit, the input IDT 6 already generates the surface acoustic wave up to EFGH, which reaches the output electrode 8. On the other hand, the delay operation of time T/2 by the delay circuit 42 causes HGFE in the pseudo noise signal to be transmitted to the input IDT 7 at this moment, whereby a surface acoustic wave therefor is generated and reaches the output electrode 8. Now coincidence is made between the two signals, so that a correlation signal is output from the output electrode 8. Therefore, a larger correlation signal is output from the adder 25.

In the present embodiment as described, the length of output electrode is a half of that in the conventional apparatus and therefore the length of convolver can be shortened, which enables the size reduction of correlator. Further, since the delay circuit elements are formed together with the convolvers on the same piezo-electric substrate, if a temperature change or the like should change the propagation speed of surface acoustic waves, the change would be the same for the convolvers and for the delay circuit elements. This leads to such an advantage that even if the delay time of delay circuit element should change, the change could be negligible.

Second Embodiment

Figure 5:
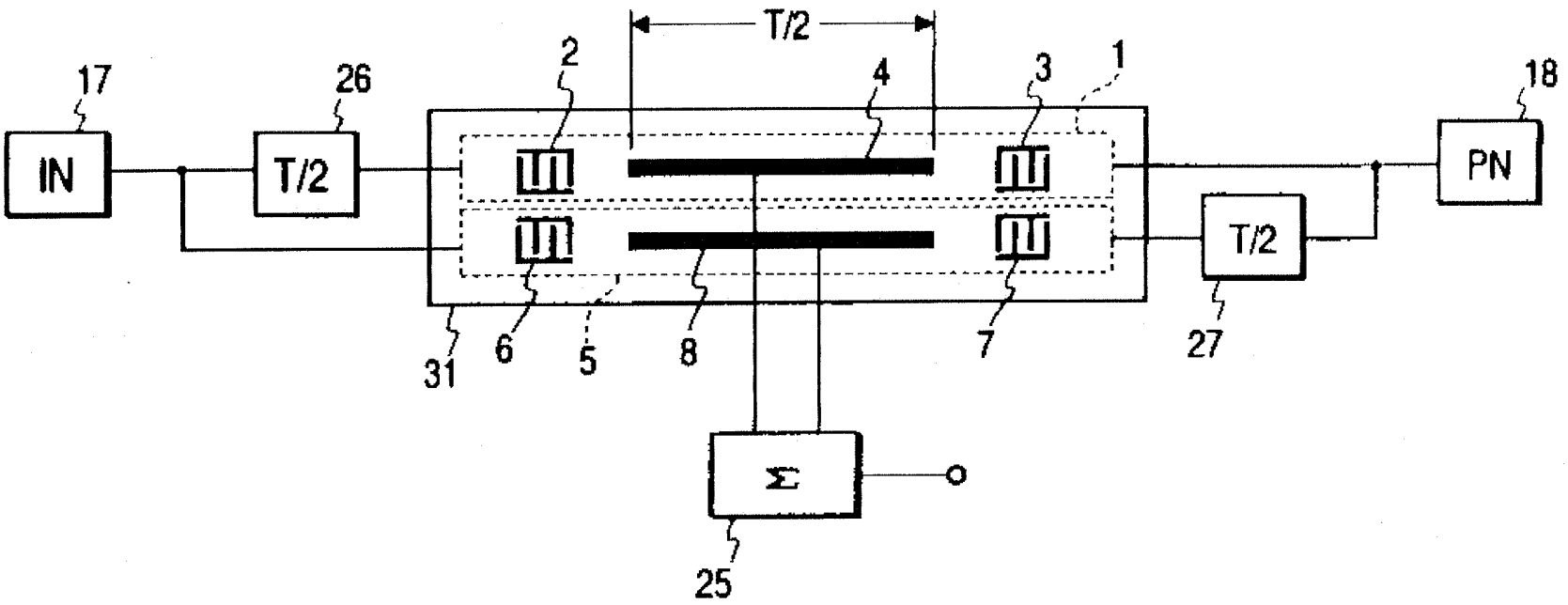
FIG. 5 is a schematic plan view to show a second embodiment of correlator according to the present invention.

FIG. 5 is a schematic plan view to show the second embodiment of correlator according to the present invention. In FIG. 5, the same members as those in FIG. 3 are denoted by the same reference numerals.

In the present embodiment, the delay circuits are not formed on the piezo-electric substrate 31, but a delay circuit 26 is provided intermediate between the signal input circuit 17 and the input IDT 2 of convolver 1, and a delay circuit 27 between the PN signal (reference signal) generator 18 and the input IDT 7 of convolver 5. The delay time of delay circuits 26, 27 is equal to the time in which surface acoustic waves generated from the input IDTs 2, 3, 6, 7 propagate the length of output electrodes 4, 8. In the present embodiment, a surface acoustic wave based on the input signal from the signal input circuit 17 propagates from left to right while a surface acoustic wave based on the pseudo noise signal (reference signal) from right to left.

The delay function of the delay circuits 26, 27 in the present embodiment is the same as that of the delay circuit elements in the first embodiment, and therefore the same operation as described with FIG. 4A to FIG. 4D can be achieved.

Third Embodiment

Figure 6:
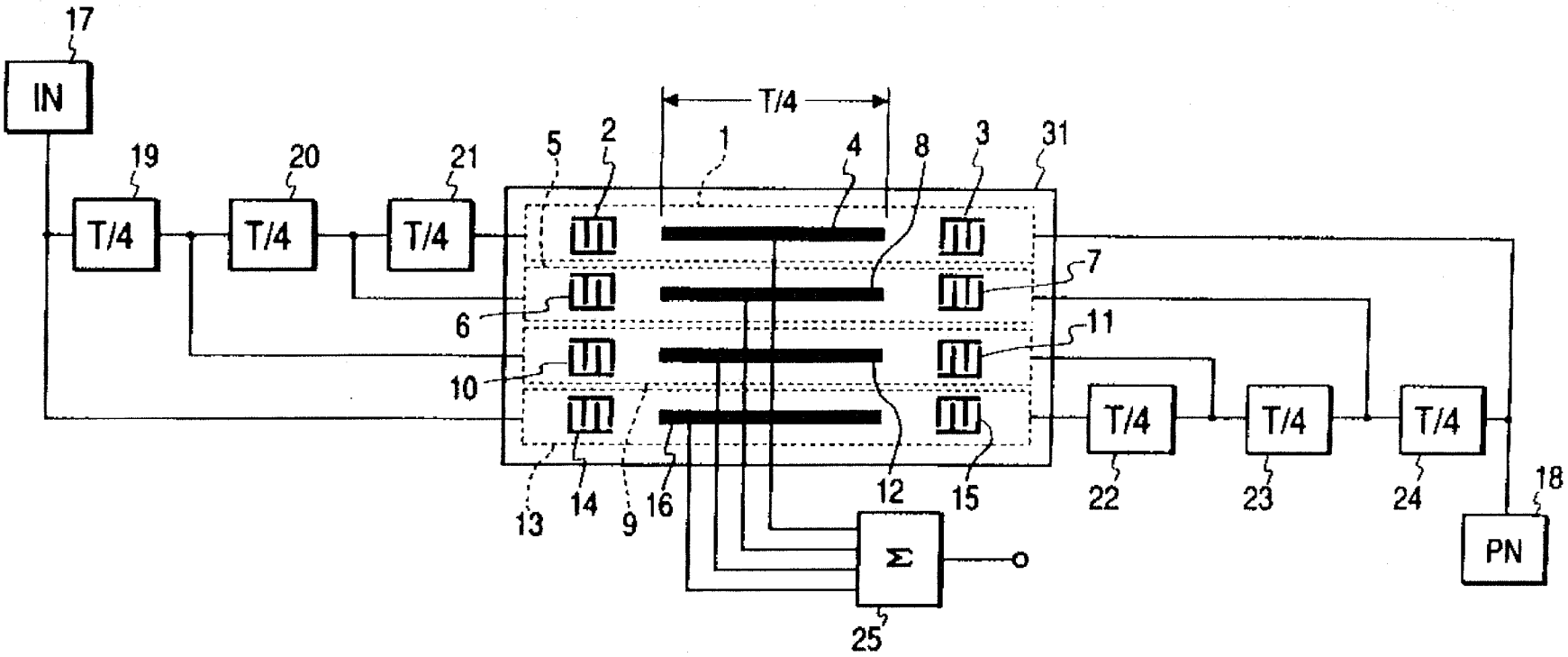
FIG. 6 is a schematic plan view to show a third embodiment of correlator according to the present invention.

FIG. 6 is a schematic drawing to show the third embodiment of correlator according to the present invention. In FIG. 6, the same members as those in FIG. 3 and in FIG. 5 are denoted by the same reference numerals.

In the present embodiment, four convolvers 1, 5, 9, 13 are formed on a piezo-electric substrate 31. The convolver 9 has input IDTs 10, 11 and a convolution output electrode 12, and the convolver 13 input IDTs 14, 15 and a convolution output electrode 16. The four convolvers 1, 5, 9, 13 have the same shape and function. In the present embodiment, the length of output electrode 4, 8, 12, 16 of each convolver is equal to a distance which a surface acoustic wave travels in a time (T/4) which is a quarter of period T of code strings in pseudo noise signal as reference signal. An adder 25 adds convolution outputs from the four output electrodes 4, 8, 12, 16 to obtain a correlation signal.

Each numeral 19, 20, 21, 22, 23, 24 denotes a delay circuit. These delay circuits are arranged as shown between either a signal input circuit 17 or a PN signal (reference signal) generator 18 and an input IDT 2, 6, 7, 10, 11, 15 in convolver 1, 5, 9, 13. A delay time of each delay circuit 19, 20, 21, 22, 23, 24 is equal to a time in which a surface acoustic wave generated from each input IDT 2, 3, 6, 7, 10, 11, 14, 15 in convolver 1, 5, 9, 13 travels the length of output electrode 4, 8, 12, 16. In more detail, an input signal from signal input circuit 17 is delayed for a time of 3T/4 and then input into the input IDT 2 in convolver 1, an input signal from signal input circuit 17 is delayed for a time of T/2 and then input into the input IDT 6 in convolver 5, and an input signal from signal input circuit 17 is delayed for a time of T/4 and then input into the input IDT 10 in convolver 9. Also, a pseudo noise signal from PN signal generator 18 is delayed for a time of T/4 and then input into the input IDT 7 in convolver 5, a pseudo noise signal from PN signal generator 18 is delayed for a time of T/2 and then input into the input IDT 11 in convolver 9, and a pseudo noise signal from PN signal generator 18 is delayed for a time of 3T/4 and then input into the input IDT 15 in convolver 13.

Figure 7:
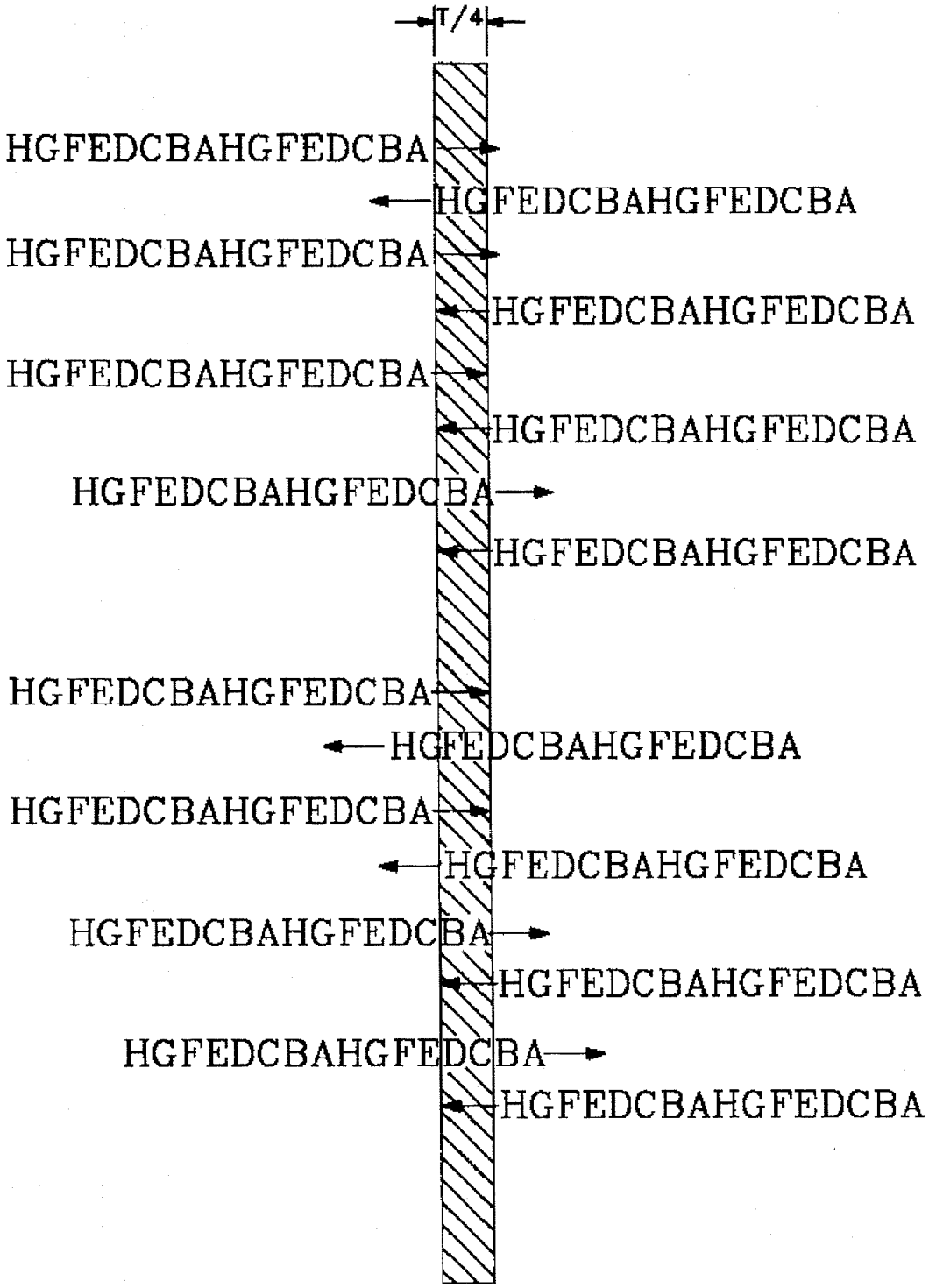
FIG. 7 and FIG. 8 are illustrations to describe the operation of the correlator shown in FIG. 6.
Figure 8:
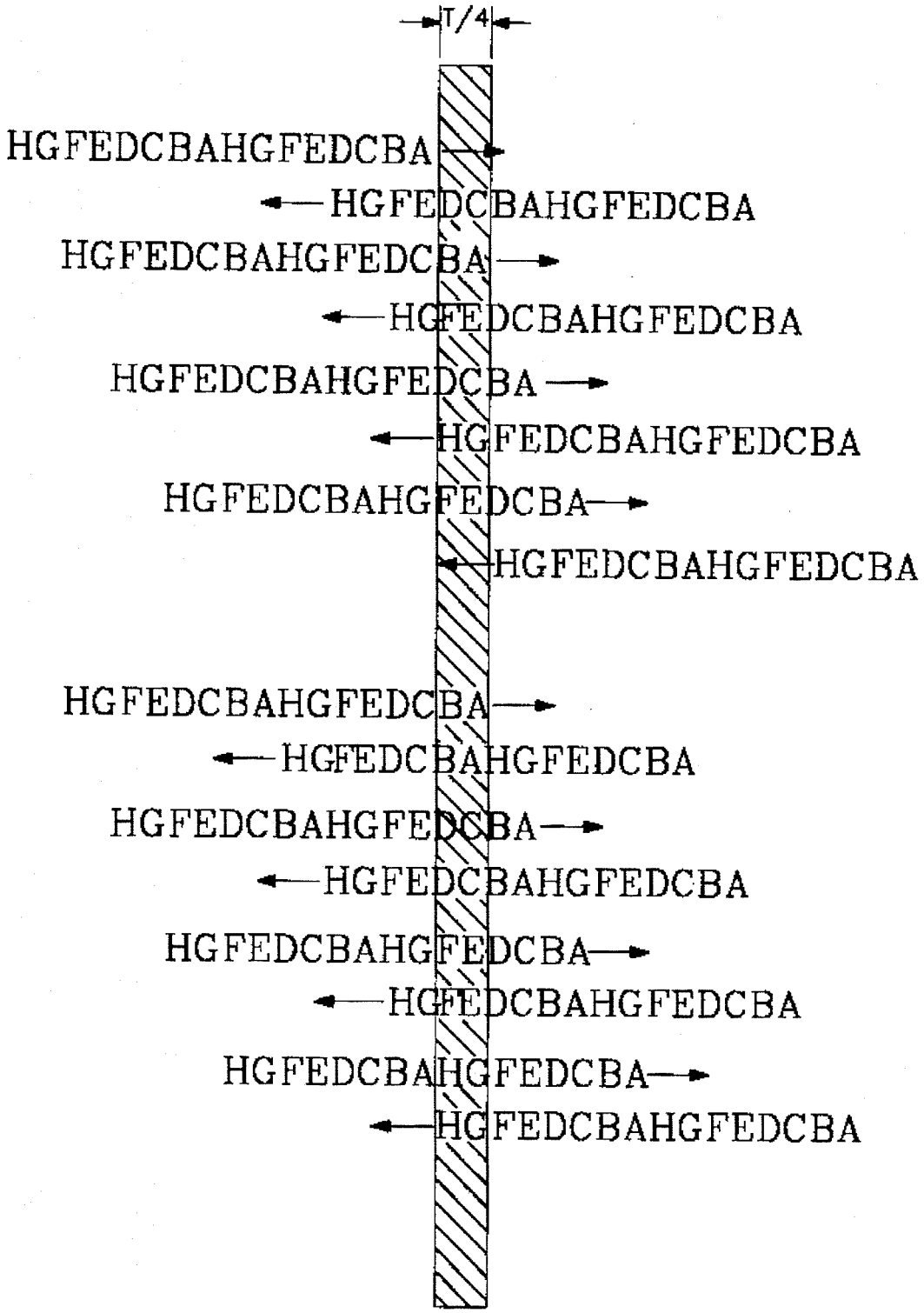

FIG. 7 and FIG. 8 are illustrations to describe the operation of the present embodiment. These illustrations are explanatory drawings similar to FIG. 4A to FIG. 4D for the first embodiment. Suppose the PN signal (reference signal) generator 18 generates a signal of ABCDEFGH and the signal input circuit 17 does the same signal. However, the pseudo noise signal (reference signal) is input into IDT in the order of HGFEDCBA reverse to that of code strings in input signal from the signal input circuit 17. In this occasion, the contents of each code string A, B, C, . . . are also reversed in order. In the drawings, the hatched portion represents a position of output electrode 4, 8, 12, 16 in each convolver.

In the upper half of FIG. 7, four sets of code strings show states of convolvers 1, 5, 9, 13 after the time of T/4 has elapsed.

In the lower half of FIG. 7, four sets of code strings show states of convolvers 1, 5, 9, 13 after an additional time of T/4 has further elapsed (which means that the time of T/2 has elapsed from the beginning).

In the upper half of FIG. 8, four sets of code strings show states of convolvers 1, 5, 9, 13 after a further time of T/4 has elapsed (which means that the time of 3T/4 has elapsed from the beginning).

In the lower half of FIG. 8, four sets of code strings show states of convolvers 1, 5, 9, 13 after a further time of T/4 has elapsed (which means that the time of T has elapsed from the beginning).

As seen from FIG. 7 and FIG. 8, no coincidence is made between two signals at the positions of output electrodes 4, 8, 12, 16 before the time T has elapsed, so that no correlation signal is output from the output electrodes 4, 8, 12, 16. Therefore, no correlation signal is output from the adder 25. After the time T has elapsed, coincidence is made between two signals at the positions of output electrodes 4, 8, 12, 16, so that correlation signals are output from the output electrodes 4, 8, 12, 16. Therefore, the adder 25 outputs a very large correlation signal. After that, two signals become offset from each other at the positions of output electrodes, so that no correlation signal appears from the adder 25. A next correlation signal is output after a further time T has elapsed.

In the present embodiment as described, the length of output electrodes is a quarter of that in the conventional apparatus, which remarkably shortens the length of convolvers, enabling satisfactory size reduction of correlator.

It should be noted that the present invention does not have to be limited to the arrangements using two or four convolvers as in the above embodiments but can be applicable to arrangements using n convolvers, where n is an arbitrary integer of at least 2. Generalizing the present invention with period T of reference signal, the n convolvers each have an action time of T/n. This means that each output electrode in convolver has a length equal to a distance which a surface acoustic wave propagates in the time of T/n on the piezo-electric substrate. Further, a correlator using the above n convolvers has delay means for delaying an information signal input into the k-th convolver among the n convolvers for a time of (k−1)T/n, where k=1, 2, . . . , n, and for delaying a reference signal input into the k-th convolver for a time of (n-k)T/n, and adding means for adding convolution signals output from the n convolvers.

The third embodiment shown in FIG. 6 is an example of n=4 in the above general expression. Here, the delay elements 19 to 24 are the above delay means and the adder 25 the adding means. A delay time of information signal input into the first convolver 13 can be calculated by substituting k=1 into (k−1)T/n, obtaining 0. Therefore, the information signal is input into the first convolver 13 without being delayed by the delay means. On the other hand, a delay time for reference signal input into the first convolver 13 can be calculated by substituting n=4 and k=1 into (n−k)T/n, obtaining 3T/4. Therefore, the reference signal is input into the first convolver 13 with a delay time of 3T/4. Similarly, an information signal is input into the second convolver 9, the third convolver 5 or the fourth convolver 1 with a delay of T/4, T/2 or 3T/4, respectively. Also, a reference signal is input into the second convolver 9 or the third convolver 5 with a delay of T/2 or T/4, respectively. A reference signal is input into the fourth convolver 1 with a delay time of 0, that is, without any delay.

Figure 9:
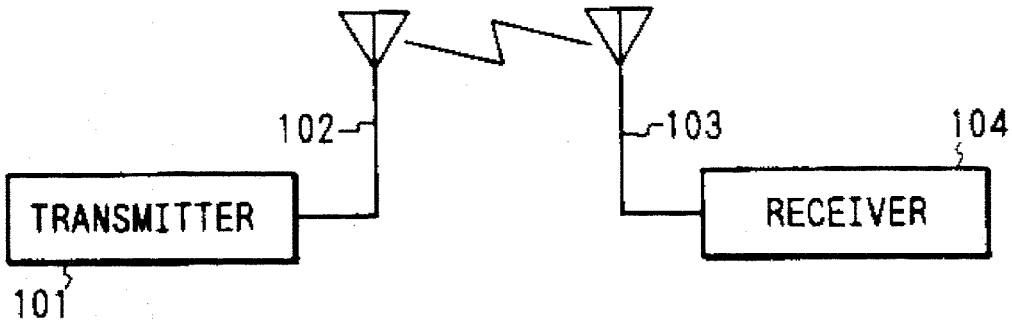
FIG. 9 is a block diagram to show an embodiment of communication system of the present invention.

FIG. 9 is a block diagram to show an embodiment of communication system of the present invention. In FIG. 9, a transmitter 101 sends transmission data as spread spectrum information signal through an antenna 102. The thus sent signal is received by a receiver 104 through an antenna 103.

Figure 10:
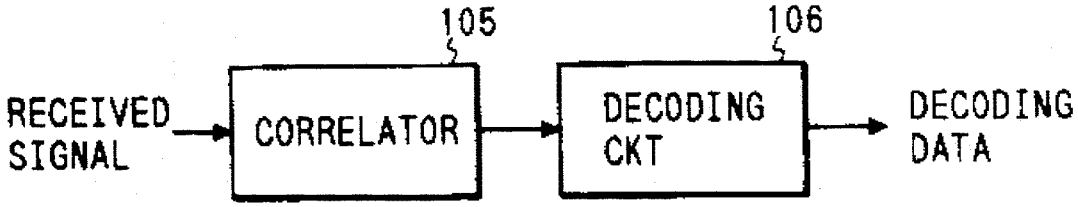
FIG. 10 is a block diagram to show an example of construction of the receiver used in the communication system shown in FIG. 9.

FIG. 10 is a block diagram to show an example of arrangement of receiver 104. The receiver 104 is arranged to have a correlator 105 of the present invention, for example one as shown in FIG. 3, FIG. 5 or FIG. 6, and a decoding circuit 106. The received signal is input into a signal input circuit 17, for example as shown in FIG. 3, etc., in the correlator 105. Then an adder 25, for example as shown in FIG. 3, etc., in correlator 105 outputs a correlation signal, and then it is input into the decoding circuit 106. The decoding circuit 106 decodes the transmitted data from the thus input correlation signal, and outputs the decoded data.

There are various applications of the present invention in addition to the embodiments as described above. The present invention includes all such applications and modifications falling within the scope of the appended claims.

As described above, the present invention employs a combination of plural convolvers and plural delay circuits so as to shorten the length of output electrodes of convolvers, which enables the size reduction of correlator.

Further, when the surface acoustic wave delay circuits and the surface acoustic wave convolvers are formed on a common substrate, an incidental change in propagation speed of surface acoustic waves for example due to a temperature change is equal for all convolvers and delay circuits, so that a change in delay time of delay circuits can be negligible, achieving a correlator stable in performance even with an environmental change.

What is claimed is:

1. A correlator comprising:

reference signal generating means for generating a reference signal with period T;

n convolvers each having an action time of T/n where n is an integer of at least 2, into each of which an information signal and the reference signal are input and each of which outputs a convolution signal of the information signal and the reference signal, the n convolvers being arranged in parallel on one substrate;

delay means for delaying an information signal input into a k-th convolver among the n convolvers for a time of (k−1)T/n where k=1, 2, . . . , n and for delaying a reference signal input into the k-th convolver for a time of (n-k)T/n; and adding means for adding convolution signals respectively output from the n convolvers.

2. A correlator according to claim 1, wherein the one substrate is a piezo-electric substrate, each of said n convolvers on said piezo-electric substrate comprises a first input inter-digital transducer formed on said piezo-electric substrate, for generating a first surface acoustic wave according to an input information signal thereinto, a second input inter-digital transducer formed on said piezo-electric substrate, for generating a second surface acoustic wave according to a reference signal thereinto, and an output electrode formed on said piezo-electric substrate, for outputting a convolution signal of the information signal and the reference signal.

3. A correlator according to claim 2, wherein each of the output electrodes of said n convolvers has a length equal to a distance which the first and second surface acoustic waves propagate in a time of T/n on the substrate.

4. A correlator according to claim 2, wherein the piezo-electric substrates for said n convolvers are a single substrate integrally formed.

5. A correlator according to claim 2, wherein said delay means comprises surface acoustic wave filters formed on a same piezo-electric substrate as the convolvers are formed.

6. A correlator comprising:

a reference signal generating circuit for generating a reference signal with period T;

n convolvers each having an action time of T/n where n is an integer of at least 2, into each of which an information signal and the reference signal are input and each of which outputs a convolution signal of the information signal and the reference signal, the n convolvers being arranged in parallel on one substrate;

an input circuit for making an information signal input into each of the n convolvers;

a first delay circuit provided between the input circuit and the n convolvers, for delaying an information signal input into a k-th convolver among the n convolvers for a time of (k−1)T/n where k=1, 2, . . . , n;

a second delay circuit provided between the reference signal generating circuit and the n convolvers, for delaying a reference signal input into the k-th convolver among the n convolvers for a time of (n-k)T/n; and an adding circuit for adding convolution signals respectively output from the n convolvers.

7. A correlator according to claim 6, wherein the one substrate is a piezo-electric substrate, each of said n convolvers on said piezo-electric substrate comprises a first input inter-digital transducer formed on said piezo-electric substrate, for generating a first surface acoustic wave according to an input information signal thereinto, a second input inter-digital transducer formed on said piezo-electric substrate, for generating a second surface acoustic wave according to a reference signal thereinto, and an output electrode formed on said piezo-electric substrate, for outputting a convolution signal of the information signal and the reference signal.

8. A correlator according to claim 7, wherein each of the output electrodes of said n convolvers has a length equal to a distance which the first and second surface acoustic waves propagate in a time of T/n on the substrate.

9. A correlator according to claim 7, wherein the piezo-electric substrates for said n convolvers are a single substrate integrally formed.

10. A correlator according to claim 7, wherein said delay means comprises surface acoustic wave filters formed on a same piezo-electric substrate as the convolvers are formed.

11. A correlator according to claim 6, wherein each of said first and second delay circuits comprises (n−1) delay elements connected in series.

12. A correlator comprising:

reference signal generating means for generating a reference signal with a predetermined period;

first and second convolvers each having an action time which is a half of the period of the reference signal, into each of which an information signal and the reference signal are input and each of which outputs a convolution signal of the information signal and the reference signal, the first and second convolvers being arranged in parallel on one substrate;

delay means for delaying an information signal input into the second convolver for a time equal to a half of the period of the reference signal and for delaying a reference signal input into the first convolver for a time equal to a half of the period of the reference signal; and adding means for adding convolution signals respectively output from the first and second convolvers.

13. A correlator according to claim 12, wherein said first convolver on said one piezo-electric substrate comprises a first input inter-digital transducer formed on said one piezo-electric substrate, for generating a first surface acoustic wave according to an input information signal thereinto, a second input inter-digital transducer formed on said one piezo-electric substrate, for generating a second surface acoustic wave according to a reference signal thereinto, and a first output electrode formed on said one piezo-electric substrate, for outputting a convolution signal of the information signal and the reference signal and wherein said second convolver on said one piezo-electric substrate comprises a third input inter-digital transducer formed on said one piezo-electric substrate, for generating a third surface acoustic wave according to an input information signal thereinto, a fourth input inter-digital transducer formed on said one piezo-electric substrate, for generating a fourth surface acoustic wave according to a reference signal thereinto, and a second output electrode formed on said one piezo-electric substrate, for outputting a convolution signal of the information signal and the reference signal.

14. A correlator according to claim 13, wherein each of said first and second output electrodes has a length equal to a distance which the first to fourth surface acoustic waves propagate in a time equal to a half of the period of reference signal.

15. A correlator according to claim 13, wherein said delay means comprises surface acoustic wave filters formed on the same piezo-electric substrate as the first and second convolvers are formed.

16. A correlator comprising:

a reference signal generating circuit for generating a reference signal with a predetermined period;

first and second convolvers each having an action time equal to a half of a period of the reference signal, into each of which an information signal and the reference signal are input and each of which outputs a convolution signal of the information signal and the reference signal, the first and second convolvers being arranged in parallel on one substrate;

a first delay circuit for delaying an information signal input into the second convolver for a time equal to a half of the period of the reference signal;

a second delay circuit for delaying a reference signal input into the first convolver for a time equal to a half of the period of the reference signal; and an adding circuit for adding convolution signals respectively output from the first and second convolvers.

17. A correlator according to claim 16, wherein said first convolver on said one piezo-electric substrate comprises a first input inter-digital transducer formed on said one piezo-electric substrate, for generating a first surface acoustic wave according to an input information signal thereinto, a second input inter-digital transducer formed on said one piezo-electric substrate, for generating a second surface acoustic wave according to a reference signal thereinto, and a first output electrode formed on said one piezo-electric substrate, for outputting a convolution signal of the information signal and the reference signal and wherein said second convolver on said one piezo-electric substrate comprises a third input inter-digital transducer formed on said one piezo-electric substrate, a third input inter-digital transducer formed on said one piezo-electric substrate, for generating a third surface acoustic wave according to an input information signal thereinto, a fourth input inter-digital transducer formed on said one piezo-electric substrate, for generating a fourth surface acoustic wave according to a reference signal thereinto, and a second output electrode formed on said one piezo-electric substrate, for outputting a convolution signal of the information signal and the reference signal.

18. A correlator according to claim 17, wherein each of said first and second output electrodes has a length equal to a distance which the first to fourth surface acoustic waves propagate in a time equal to a half of the period of reference signal.

19. A correlator according to claim 17, wherein said first and second delay circuits are first and second surface acoustic wave filters formed on the same piezo-electric substrate as the first and second convolvers are formed.

20. A receiver comprising:

a correlator for outputting a correlation signal of a received information signal and a reference signal; and a decoding circuit for decoding data from the correlation signal output from the correlator;

wherein said correlator comprises:

reference signal generating means for generating a reference signal with period T;

n convolvers each having an action time of T/n where n is an integer of at least 2, into each of which an information signal and the reference signal are input and each of which outputs a convolution signal of the information signal and the reference signal, the n convolvers being arranged in parallel on one substrate;

delay means for delaying an information signal input into a k-th convolver among the n convolvers for a time of (k−1)T/n where k=1, 2. . . , n and for delaying a reference signal input into the k-th convolver for a time of (n-k)T/n; and adding means for adding convolution signals respectively output from the n convolvers.

21. A receiver according to claim 20, wherein the one substrate is a piezo-electric substrate, each of said n convolvers on said one piezo-electric substrate comprises a first input inter-digital transducer formed on said piezo-electric substrate, for generating a first surface acoustic wave according to an input information signal thereinto, a second input inter-digital transducer formed on said piezo-electric substrate, for generating a second surface acoustic wave according to a reference signal thereinto, and an output electrode formed on said piezo-electric substrate, for outputting a convolution signal of the information signal and the reference signal.

22. A receiver according to claim 21, wherein each of the output electrodes of said n convolvers has a length equal to a distance which the first and second surface acoustic waves propagate in a time of T/n on the substrate.

23. A receiver according to claim 21, wherein said delay means comprises surface acoustic wave filters formed on a same piezo-electric substrate as the convolvers are formed.

24. A communication system comprising:

a transmitter for transmitting an information signal; and a receiver for receiving the information signal transmitted from the transmitter and having a correlator for outputting a correlation signal of the received information signal and a reference signal;

wherein said correlator comprises:

reference signal generating means for generating the reference signal with period T;

n convolvers each having an action time of T/n where n is an integer of at least 2, into each of which an information signal and the reference signal are input and each of which outputs a convolution signal of the information signal and the reference signal, the n convolvers being arranged in parallel on one substrate;

delay means for delaying an information signal input into a k-th convolver among the n convolvers for a time of (k−1)T/n where k=1, 2, . . . , n and for delaying a reference signal input into the k-th convolver for a time of (n-k)T/n; and adding means for adding convolution signals respectively output from the n convolvers.

25. A communication system according to claim 24, wherein the one substrate is a piezo-electric substrate, each of said n convolvers on said piezo-electric substrate comprises a first input inter-digital transducer formed on said piezo-electric substrate, for generating a first surface acoustic wave according to an input information signal thereinto, a second input inter-digital transducer formed on said piezo-electric substrate, for generating a second surface acoustic wave according to a reference signal thereinto, and an output electrode formed on said piezo-electric substrate, for outputting a convolution signal of the information signal and the reference signal.

26. A communication system according to claim 25, wherein each of the output electrodes of said n convolvers has a length equal to a distance which the first and second surface acoustic waves propagate in a time of T/n on the substrate.

27. A communication system according to claim 25, wherein said delay means comprises surface acoustic wave filters formed on a same piezo-electric substrate as the convolvers are formed.

28. A communication system according to claim 24, wherein said receiver has a decoding circuit for decoding data from the correlation signal output from the correlator.

* * * * *